United States Patent [19]

Pinkney

[11] Patent Number: 4,696,595

[45] Date of Patent: Sep. 29, 1987

[54] LOOSE LEAF BINDER LIFT LOCK

[75] Inventor: James Pinkney, Southgate, Mich.

[73] Assignee: South Park Sales & Mfg., Inc., Lincoln Park, Mich.

[21] Appl. No.: 938,234

[22] Filed: Dec. 4, 1986

[51] Int. Cl.[4] ..... B42F 3/02

[52] U.S. Cl. ..... 402/54; 402/80 R

[58] Field of Search ..... 402/54, 46, 64, 66, 402/80 R

[56] References Cited

U.S. PATENT DOCUMENTS

| | | | |
|---|---|---|---|
| 1,869,790 | 8/1932 | Wolf | 402/54 |
| 2,286,060 | 8/1942 | Buenger et al. | 402/54 |
| 2,340,129 | 1/1944 | Lazaroff | 402/54 |
| 2,472,969 | 6/1949 | Guinane | 402/54 X |
| 2,568,227 | 9/1951 | Federbush | 402/54 X |
| 2,724,386 | 11/1955 | Schade | 402/54 X |
| 2,730,105 | 1/1956 | Pisciotto, Jr. et al. | 402/54 |
| 4,201,492 | 5/1980 | Almgren | 402/54 |

*Primary Examiner*—Paul A. Bell

*Attorney, Agent, or Firm*—Robert G. Mentag

[57] ABSTRACT

A loose leaf binder lift lock having a tubular body with a tapered front end, a tubular locking ball carrier mounted in the body and carrying a plurality of locking balls and movable between a ball locking position and a ball unlocking position, a retainer spring for releasably retaining the ball carrier in the tubular body in the ball locking position but permitting disassembly of the ball carrier from the body, a pull ring stud carried by the ball carrier, and a detachably mounted pull ring carried on the pull ring stud for moving the ball carrier to the ball unlocking position.

8 Claims, 14 Drawing Figures

LOOSE LEAF BINDER LIFT LOCK

BACKGROUND OF THE INVENTION

1. Technical Field

The field of art to which this invention pertains may be generally located in the class of devices relating to loose leaf binders. Class 402, entitled Loose Leaf, United States Patent Office classification, appears to be the applicable general area of art to which the subject matter similar to this invention has been classified in the past.

2. Background Information

It is known in the loose leaf binder art to provide loose leaf binder lift locks for releasably securing the hard cover of a loose leaf binder to the rear cover, with the loose leaf pages held in between said covers. Heretofore, a loose leaf binder lift lock has been provided which includes the basic components of an outer tubular body, a retainer cap for securing the body to the cover of a loose leaf binder, a ball carrier with a plurality of balls carried therein, a pull ring stud, a pull ring and a compression return spring. The last mentioned loose leaf binder lift lock components have heretofore been assembled in a condition so that it was not possible to disassemble the inner components of the binder lift lock for repair purposes. A problem solved by the present invention is the elimination of any tooling required to assemble the pull ring to the pull ring stud. Another problem solved by the present invention is the elimination of side travel of the pull ring which creates a condition whereby the pull ring may be inadvertently pulled off of the pull ring stud during use of the loose leaf binder lift lock. The loose leaf binder lift lock of the present invention also eliminates the need for grease to prevent the locking balls in the ball carrier from corroding and sticking. A disadvantage of the prior art loose leaf binder locks is that they are heavy, which results in high shipping costs, and they require an extra retainer component for pre-assembly of the body, ball carrier, spring and balls.

SUMMARY OF THE INVENTION

In accordance with the present invention, a loose leaf binder lift lock is provided which is adapted to be releasably mounted on the front hard cover of a loose leaf binder for a locking engagement with a paper retaining rod secured to the rear cover of a loose leaf binder. The loose leaf binder lift lock includes a tubular body in which is movably mounted a tubular locking ball carrier. The ball carrier is releasably retained in the tubular body by a compression retainer spring which has one end secured to the ball carrier by a spring holder means and the other end retained in the tubular body by a press-fit. The retainer spring retains the ball carrier, which carries a plurality of locking balls, in a ball locking position but permits the ball carrier to be moved by a pull ring stud and pull ring to move the balls to an unlocking position. The front outer end of the tubular body is tapered to permit easy insertion into the holes of sheets of paper in a loose leaf binder unlike the prior art designs. Contrary to the prior art, the aforementioned structure permits the inner components of the lift lock namely, the ball carrier, stud and balls to be removed for repair or replacement after the unit has been assembled into the loose leaf binder, by removing the ball carrier from the spring engagement. The parts are not damaged during such a removal or disassembly operation. The ball carrier is preferably made of zinc which eliminates the need for grease, to prevent the carbon steel balls from corroding and sticking to the ball carrier.

The pull ring stud is provided with a pair of oppositely disposed L-shaped slots into which are releasably mounted the ends of a pair of attachment arms on a pull ring. The L-shaped slots are separated by a center rib on the pull ring stud which keeps the pull ring centered to prevent it from traveling from one side to the other. The pull ring can be mounted into the L-shaped slots or removed from the same without the need for any special tools, since the stud is in a position to permit this action when the stud is moved past the ball unlocking position.

DESCRIPTION OF THE PREFERRED EMBODIMENTS

Figure 1:
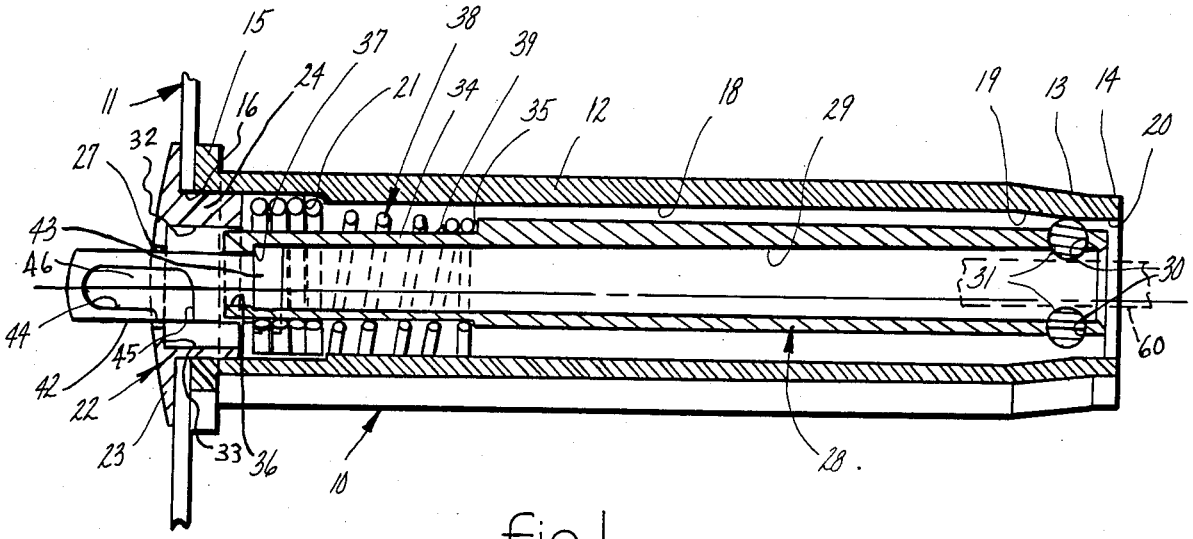
FIG. 1 is a longitudinal, partial section view, of a loose leaf binder lift lock made in accordance with the principles of the invention.

Referring now to the drawings, and in particular to FIG. 1, the numeral 10 generally designates a loose leaf binder lift lock made in accordance with the principles of the present invention. The numeral 11 generally designates a fragmentary portion of a conventional loose leaf binder hard cover. The numeral 12 designates the binder lift lock tubular body which is cylindrical in overall length, and provided with an outer surface which tapers inwardy at the front end portion 13, so as to provide a conical front end portion which terminates in a reduced diameter straight outer surface part 14. As shown in FIG. 1, the outer end of the binder lift lock 10 is provided with an integral, radial, outwardly extended flange 15.

As seen in FIG. 1, the binder lift lock body 12 is tubular, and it has an internal longitudinally extended cylindrical chamber 18 which tapers at the front end of the body inwardly, as indicated by the numeral 19. The front end of the tapered internal chamber portion 19 terminates in a reduced diameter cylindrical front end portion 20, which is open to the exterior at the front end thereof for disassembly purposes.

The diameter of the internal chamber 18 in the body 12 is increased at the outer end thereof, as indicated by the numeral 21, by a small amount, as for example 0.003 of an inch. The increased diameter chamber area 21 forms a seat for an enlarged portion of the compression spring 38, as described more fully hereinafter.

As shown in FIG. 1, the binder lift lock 10 is releasably mounted on the hard cover 11 of a loose leaf binder by a retainer cap, generally indicated by the numeral 22. The retainer cap 22 is circular in outer appearance and includes an outer flange 23 which seats against the outer face of the loose leaf binder hard cover 11. The retainer cap 22 is provided with an integral, axial, cylindrical bushing 24 on the inner side of the retainer flange 23. The retainer flange bushing 24 is adapted to be slidably mounted through a hole 16 formed in the loose leaf binder hard cover 11, and to be press fitted into the slightly enlarged outer end cylindrical chamber 21 in the compression spring end of the binder lift lock body 12.

Figure 2:
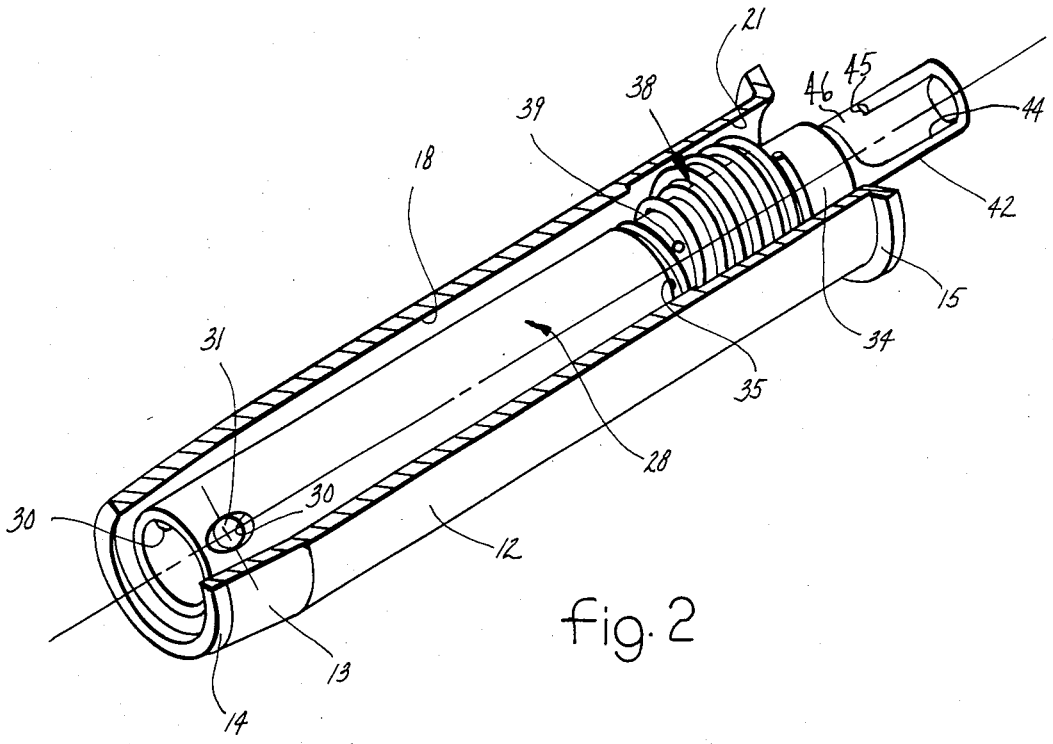
FIG. 2 is a perspective view, partly in section, of the loose leaf binder lift lock shown in FIG. 1, and with some of the parts removed.

As shown in FIGS. 1 and 2, the binder lift lock 10 includes an elongated, cylindrical, tubular, ball carrier, generally indicated by the numeral 28. The ball carrier 28 is provided with an axially extended internal bore or chamber 29. The front end of the ball carrier 28 is provided with a plurality of ball carrier holes 30, in each of which is operatively mounted a locking ball 31. The optimum number of balls 31 is three. The balls 31 are carried in the holes 30 in a position so that they have a small amount of movement laterally or transversely of the longitudinal axis of the ball carrier 28, but they are retained in the holes 30 so that they cannot move out of the holes 30 inwardy into the chamber 29.

The rear end or retainer spring end of the ball carrier 28 is provided with a reduced diameter portion, indicated by the numeral 34, around which is operatively mounted a retainer compression coil spring, generally indicated by the numeral 38. The inner end of the retainer spring 38 includes a plurality of coils of a first size diameter which are seated around the ball carrier reduced diameter portion 34 and which abut a shoulder 35 formed at the junction of the larger diameter portion thereof. One of the reduced diameter coils of the retainer spring 38 is seated against a retainer nib or a projection 39, formed on the outer periphery of the reduced diameter portion 34 of the ball carrier 28, to hold the retainer spring 38 axially in position against movement relative to the ball carrier 28. As shown in FIGS. 1 and 2, the outer end coils of the retainer spring 38 are made to a larger second size diameter, and they are seated with a press fit in the enlarged outer end portion 21 of the internal chamber in the binder lift lock body 12.

As shown in FIG. 1, the outer end of the reduced diameter portion 34 of the ball carrier 28 is adapted to be slidably moved within an axial bore 32, which extends into the retainer cap bushing 24 from the inner end thereof, and which terminates at an end wall marked 33 when the ball carrier 28 is moved from the paper rod gripping position shown in FIG. 1 to the retracted position. As shown in FIG. 1, the internal chamber or bore 29 in the ball carrier 28 has a reduced diameter portion 36 at the rear end thereof. A shoulder 37 is formed at the junction point between the bore 29 and the reduced diameter bore portion 36.

Figure 12:
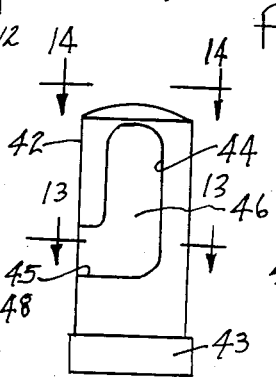
FIG. 12 is a side elevation view of the pull ring stud employed in the invention.
Figure 13:
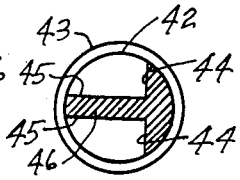
FIG. 13 is a horizontal cross section view of the pull ring stud illustrated in FIG. 12, taken along the line 13—13 thereof, and looking in the direction of the arrows.
Figure 14:
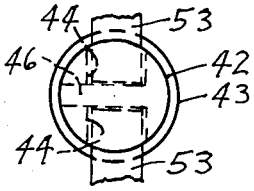
FIG. 14 is a top view of the pull ring stud illustrated in FIG. 12, taken along the line 14—14 thereof, and looking in the direction of the arrows.

As shown in FIG. 1, a pull ring stud 42 is slidably mounted through the reduced diameter bore portion 36 in the ball carrier 28. The stud 42 extends outwardly through the axial bore 32 and a hole 27 in the retainer cap 22. The outward movement of the stud 42 is limited by an integral, peripheral flange or shoulder 43 which abuts the shoulder 37 formed at the junction of the ball carrier bores 29 and 36. As best seen in FIGS. 12, 13 and 14, the stud 42 is provided on opposite sides thereof, with a pair of L-shaped slots, which each comprise a longitudinal slot 44 having an inner end and an outer end, and an entrance slot 45 communicating with the inner end of the longitudinal slot. The pair of L-shaped slots are separated by a central, longitudinally extended rib 46. It will be seen that the transverse entrance slot 45 opens to the exterior of the stud 42.

Figure 9:
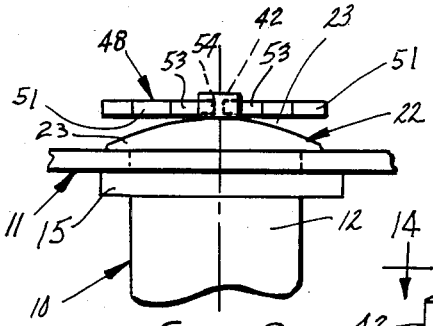
FIG. 9 is fragmentary view of the pull ring end of the binder lift lock of the present invention, and showing the binder lift lock mounted in a loose leaf cover, and with the pull ring in a position where the lift lock is in a locked position on a loose leaf binder rod to hold the papers in a loose leaf binder in a locked position.
Figure 11:
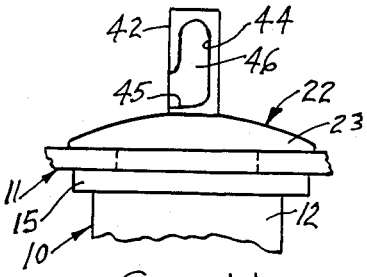
FIG. 11 is a partial view, similar to FIG. 10, but showing the pull ring removed from the pull ring stud, and with the pull ring stud rotated to a position 90 degrees from the position shown in FIG. 10, and fully extracted to allow pull ring assembly.
Figure 10:
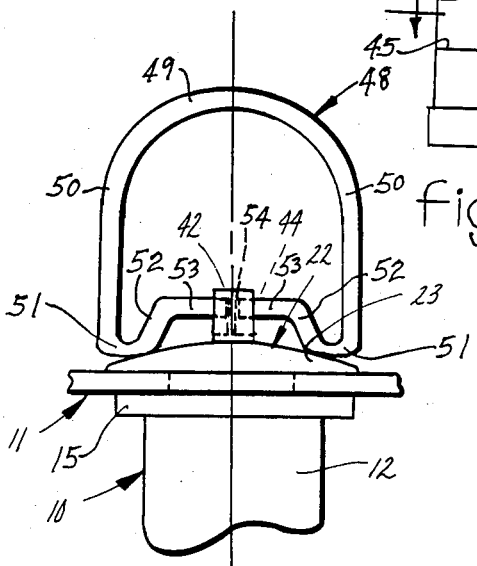
FIG. 10 is a fragmentary view of the pull ring end of the binder lift lock made in accordance with the invention, and showing the same structure as shown in FIG. 9 but with the pull ring pivoted 90 degrees to a position to unlock the binder lift lock from the paper rod.

As shown in FIGS. 9 and 10, a conventional pull ring 48 is operatively mounted on the stud 42 by the following described structure. The pull ring 48 comprises an outer semi-circular end portion 49, the ends of which terminate in a pair of parallel, spaced apart legs 50. As shown in FIG. 10, the legs 50 of the pull ring 48 each terminate in a U-shaped foot portion 51. Integrally attached to each of the foot portions 51 is an inwardly and outwardly extended connector leg 52, which extends at an acute angle inwardly of the adjacent leg 50 and back towards the curved portion 49. Each of the connector legs 52 are integrally connected to the outer end of one of a pair of transverse attachment arms 53. As shown in FIG. 10, the inner ends 54 of the attachment arms 53 are spaced apart, and they are seated in the L-shaped slots in the stud 42 on the opposite sides of the dividing rib 49. The pull ring 48 is shown in a position in FIG. 10 in which the stud 42 is pulled outwardly against the pressure of the return or retainer spring 38. In FIG. 9 the stud 42 has been moved inwardly by the return action of the spring 38.

The ball carrier 28 is preferably made from zinc, and the balls 31 from carbon steel, so that no grease is needed to prevent the balls 31 from corroding and sticking as occurs in the prior art ball carriers. The front end of the body 12 is tapered at the area 13 to permit easily removable and insertion of the body 12 in the mating holes in the paper in a loose leaf binder.

Figure 3:
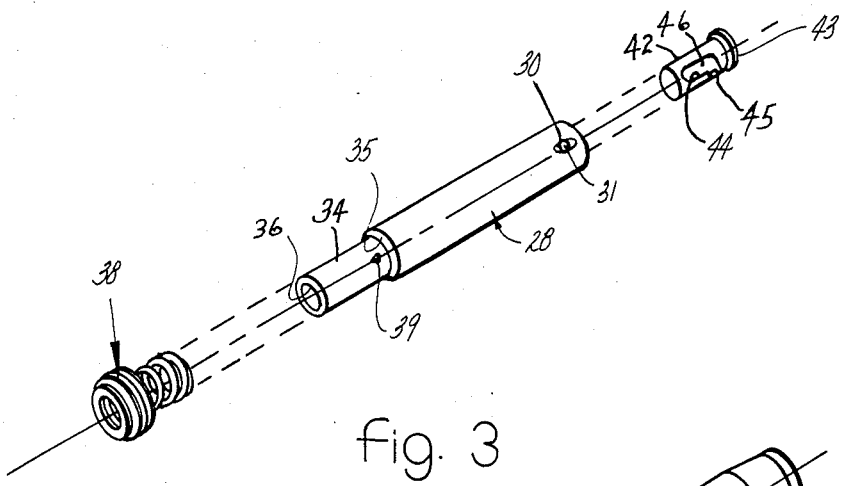
FIG. 3 is a perspective view of the compression spring, ball carrier and pull ring stud employed in the invention and showing the method of assembling these parts.
Figure 4:
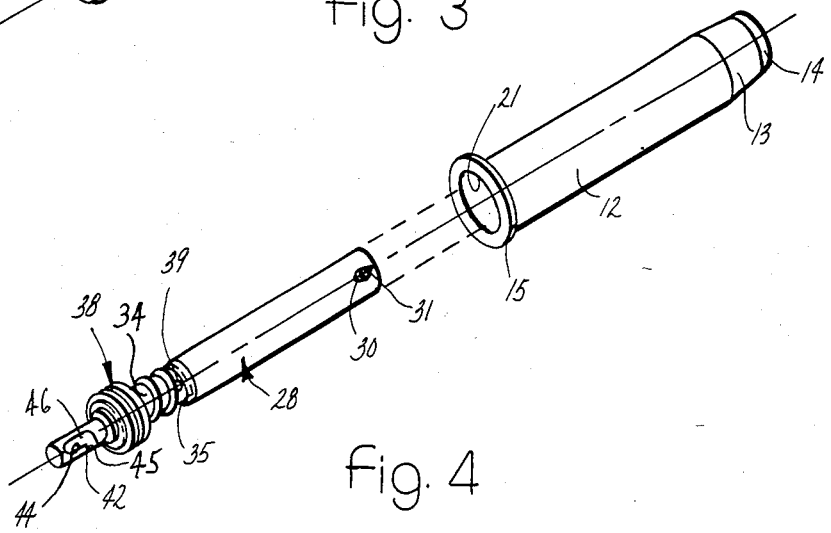
FIG. 4 is a perspective view of the assembled compression spring on the ball carrier with the pull ring stud, and showing the method of assembling that subassembly into the body of the binder lift lock.

FIG. 3 shows the assembly of the stud 42 in the ball carrier 28. The stud 42 is mounted in the ball carrier 28 from the ball end thereof, and it slides through the same and into the position shown in FIGS. 1 and 4. The retainer spring 38 is pressed over the reduced diameter end portion 34 of the ball carrier 28 into the position shown in FIG. 4. The sub-assembly of the ball carrier 28, stud 42 and retainer spring 38 is then mounted into the body 12, as shown in FIG. 4, and it is press-fitted in place, with the larger coils of the retainer spring 38 engaging the body chamber portion 21 to hold the ball carrier sub-assembly in the body 12 in the position shown in FIG. 1. The retainer cap 22, carrying a loose leaf binder cover 11, is then press-fitted into the outer end of the body chamber 21 in the body 12. A pressure is then exerted on the ball end of the ball carrier 28 to move it to the left, into the bore 32 in the bushing 34 on the retainer cap 22. The pull ring 48 is then slipped over the rib 46 on the stud 42, and the attachment arms 53 of the pull ring 48 are then moved inwardly through the transverse slot portions 45, and then longitudinally into the longitudinal slot portions 44, and into the operative position shown in FIGS. 9 and 10. The reverse procedure may be followed to remove the pull ring 48 for disassembling the binder lift lock 10. It will be seen, that the pull ring 48 may be quickly and easily removed for repairing the lift lock 10, if necessary, without the need for any special tool to bend the attachment arms 53 in a manner to release them from the stud 42 as is required in all the prior art lift locks.

Figure 5:
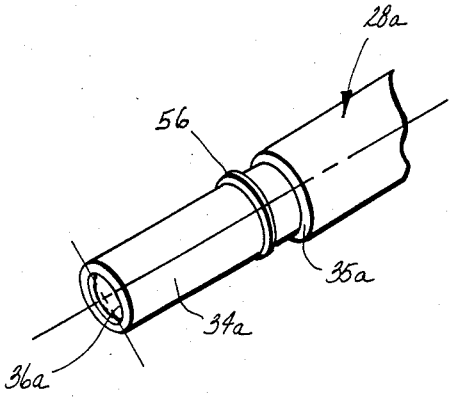
FIG. 5 is a fragmentary, perspective view of the compression spring end of the ball carrier, and showing one embodiment for securing the compression spring on the ball carrier, and which comprises an annular, outwardly extended ring that is formed integral around the periphery of said end of the ball carrier.
Figure 6:
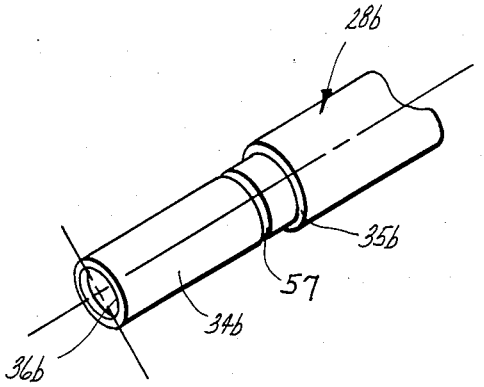
FIG. 6 is a view similar to FIG. 5, and showing an inwardly formed peripheral ring or groove around the compression spring end of the ball carrier, to illustrate another spring retainer means that may be employed in the invention.

FIGS. 5 and 6 illustrate two types of spring holder means for holding the retainer spring 38 on the ball carrier. In FIG. 5 the parts of the ball carrier **28*a* which are the same as the parts of the ball carrier 28 illustrated in FIGS. 1 through 4 have been marked with the same reference numerals followed by the small letter "a". In FIG. 5 the spring holder means is illustrated as a peripheral, radially outward extended, integral ring 56 formed on the outer surface of the reduced diameter 34*a* of the ball carrier 28*a*. In FIG. 6 the parts of the ball carrier 28*b* which are the same as the ball carrier 28 illustrated in FIGS. 1 through 4 have been marked with the same reference numerals followed by the small letter "b". The spring holder means illustrated in FIG. 6 comprises a radially inward extended peripheral groove 57 formed around the periphery of the reduced diameter portion 34*b* of the ball carrier 28*b***.

Figure 7:
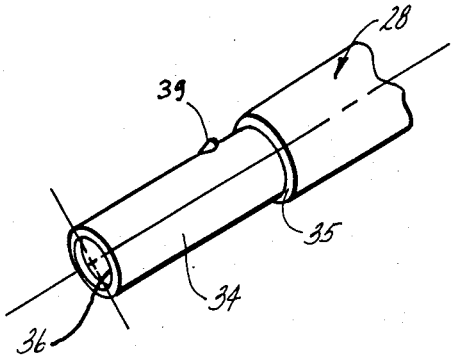
FIG. 7 is a partial perspective view of the compression spring end of the ball carrier, similar to FIG. 5, and showing still another protrusion on the ball carrier for retaining the compression spring in place, and comprising a retainer nib.
Figure 8:
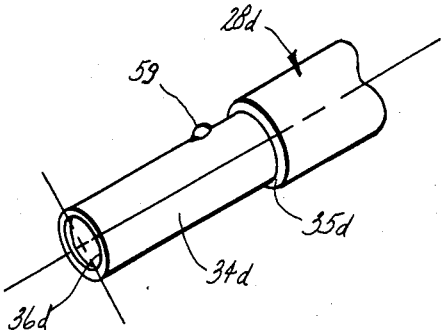
FIG. 8 is a partial perspective view of the compression spring end of the ball carrier, and showing still a further embodiment of a protrusion for the spring retainer means, and comprising a ball type protrusion.

FIG. 7 shows the spring retainer means illustrated in FIG. 1, and which is in the form of an integral protrusion that engages one of the coils of the retainer spring 38 and holds the retainer spring 38 on the ball carrier 28. FIG. 8 shows a different type of a spring holder means formed on the outer surface of the ball carrier. The parts of the ball carrier **28*d* which are the same as the parts illustrated in FIGS. 1 through 4 have been marked with the same reference numerals followed by the small letter "d". The spring holder means illustrated in FIG. 8 comprises an integral ball-shaped protrusion formed on the ball carrier reduced diameter portion 34*d* for engagement with the retainer spring 38 to hold it in place on the ball carrier 28*d***.

FIG. 1 shows the binder lift lock 10 in a position locked over a loose leaf sheet retainer rod 60. In that position the, when it is desired to remove the binder lock 10 from the loose leaf binder rod 60 to insert or remove sheets of loose leaf paper, a longitudinal pull or force is exerted on the pull ring 48 to pull the stud 42 to the left, as viewed in FIG. 1, so as to move the front end of the ball carrier 34 into the bore 32 in the retainer cap 22 and permit the balls 31 to become unlocked from the rod 60 and to move radially outward into the enlarged portion of the angled chamber 19 in the body 12. When the pull force is removed from the pull ring 48 the retainer spring 38 then functions to move the ball carrier 28 and stud assembly to the right, as viewed in FIG. 1, back to the rod gripping position against the rod 60.

The binder lift lock of the present invention with its easily removable pull ring structure, provides for reduced labor and costs associated with the assembly of the pull ring 48 onto the pull ring stud 42, since the pull ring 48 can be assembled onto the stud 42 in a shorter time than the prior art pull rings can be assembled on the prior art pull ring studs. The pull ring 48 of the present invention can be disassembled and reused without the use of any special tools. The prior art pull rings employ many different forms or designs, and they are not interchangeable, whereas the pull ring and stud combination of the present invention may employ many different designs of pull rings.

It will be seen that the pull ring stud central ring rib 46, which is disposed between the two L-shaped slots formed in the stud 42, keeps the pull ring attachment arms 53 in a centered position on the stud 42, so that neither attachment arm 53 is favored one over the other, and the chances of the attachment arms 53 coming off of the stud 42 are reduced, as compared to the prior art pull rings wherein sideward movements and the chances of the pull ring attachment arms coming off the stud are greatly increased because the attachment arms of the prior art pull rings are merely pushed into the opposite ends of a transverse hole in the stud.

What is claimed is:

1. A loose leaf binder lift lock having a tubular body, a tubular locking ball carrier movably mounted in the body and carrying a plurality of locking balls in one end for locking engagement with a locking rod attached to the rear cover of a loose leaf binder, a pull ring stud mounted in the other end of the ball carrier, a retainer spring for retaining the ball carrier, and a pull ring attached to the pull ring stud for moving the ball carrier to a ball unlocking position, characterized in that:

(a) the pull ring stud has a longitudinal slot, having an outer end and an inner end, formed on each of a pair of diametrical opposite sides and spaced transversely apart by a central rib;

(b) each of said longitudinal slots having a communicating entrance slot at the inner end thereof; and, (c) the pull ring has a pair of attachment arms, with their inner ends spaced apart from each other, and with each attachment arm detachably mounted in one of the longitudinal slots, and movable into or out of the longitudinal slots through the entrance slots when the ball carrier is moved to the unlocking position.

2. A loose leaf binder lift lock as defined in claim 1, wherein:

(a) said tubular body is provided with a tapered front end outer periphery.

3. A loose leaf binder lift lock as defined in claim 2, wherein:

(a) the retainer spring is mounted around the rear end of the ball carrier and includes a first plurality of coils releasably secured to the ball carrier by a spring holder means for holding the spring on the ball carrier; and, (b) the retainer spring further includes a second plurality of coils having a diameter larger than the diameter of the first plurality of coils and being press-fitted into the tubular body to releasably retain the ball carrier in the tubular body and to allow longitudinal movement of the ball carrier in the tubular body between ball locking and unlocking positions.

4. A loose leaf binder lift lock as defined in claim 3, wherein:

(a) said spring holder means comprising an integral retainer nib on the outer periphery of the tubular ball carrier.

5. A loose leaf binder lift lock as defined in claim 3, wherein:

(a) said spring holder means comprises an integral ball-shaped protrusion on the outer periphery of the tubular ball carrier.

6. A loose leaf binder lift lock as defined in claim 3, wherein:

(a) said spring holder means comprises an integral radially outward extended annular flange on the periphery of the tubular ball carrier.

7. A loose leaf binder lift lock as defined in claim 3, wherein:

(a) said spring holder means comprises an annular groove formed around the periphery of the tubular ball carrier.

8. A loose leaf binder lift lock as defined in claim 3, wherein:

(a) the tubular ball carrier is made from zinc.

* * * * *